United States Patent [19]

Valbert

[11] 4,102,316

[45] Jul. 25, 1978

[54] HYDROMECHANICAL SHUTOFF FOR AN INTERNAL COMBUSTION ENGINE

[75] Inventor: Gary Glen Valbert, Peoria, Ill.

[73] Assignee: Caterpillar Tractor Co., Peoria, Ill.

[21] Appl. No.: 785,632

[22] Filed: Apr. 7, 1977

[51] Int. Cl.[2] ..... F02B 77/08

[52] U.S. Cl. ..... 123/198 DB; 123/41.15; 123/196 S; 123/139 AZ

[58] Field of Search ..... 123/198 D, 198 DB, 196 S, 123/139 AZ, 41.15

[56] References Cited

U.S. PATENT DOCUMENTS

| | | | |
|---|---|---|---|
| 2,260,576 | 10/1941 | Maybach | 123/198 DB |
| 2,471,387 | 5/1949 | Cooper | 123/198 DB |
| 2,551,429 | 5/1951 | Eppens | 123/198 DB X |
| 3,153,403 | 10/1964 | Dobbs | 123/198 DB X |
| 3,977,384 | 8/1976 | John | 123/198 D X |
| 4,019,489 | 4/1977 | Cartmill | 123/198 D |

*Primary Examiner*—Charles J. Myhre
*Assistant Examiner*—Ura S. Lazarus
*Attorney, Agent, or Firm*—Phillips, Moore, Weissenberger, Lempio & Majestic

[57] ABSTRACT

An engine shutoff device includes provisions to shut down an internal combustion engine under conditions outside the normal operating limits of the engine. While the engine is idling, shutdown is initiated by fuel cutoff when engine oil pressure is below a predetermined level. As engine speed increases the low oil pressure cutoff provided in the idle range is isolated from the system so that shutdown again by fuel cutoff will occur if oil pressure drops below a second predetermined level relatively greater than first predetermined level. Engine shutdown is also initiated by fuel cutoff when either coolant temperature or lubricant temperature is excessive. The engine can be manually shut down by an emergency valve that causes cutoff of the fuel and air supply. Finally, the device initiates engine shutdown by both fuel and air cutoff when an overspeed condition occurs. The device is comprised of a self-contained fluid pump, a speed-responsive valve spool, and a series of pilot operated valves which, with appropriate passages, form a series of fluid circuits. Engine lubricating oil is pressurized by the self-contained fluid pump and is passed through the series of circuits. Appropriate pressure and temperature sensing devices along with a speed sensing device are operable upon variation of pressure, temperature, or speed in the various circuits to actuate fuel shutoff or air shutoff as required.

27 Claims, 11 Drawing Figures

25

111
103
IX
VII
110
118
109
105
98
107
124
90
44
92
89
93
117
95
97
76
121
122
84
78
87
86
126
83
83
85
82
IX
VII
44
43
40
120
16'
80

HYDROMECHANICAL SHUTOFF FOR AN INTERNAL COMBUSTION ENGINE

BACKGROUND OF THE INVENTION

This invention relates to a device to automatically shut off an internal combustion engine upon exceeding operating limits of the engine. In particular, it relates to a device for shutting off a diesel engine by terminating fuel supply to the engine when oil pressure is below operating limits, or when either coolant temperature or oil temperature exceed operating limits. Provision is also included for engine shutoff by terminating fuel and air supply upon an overspeed condition.

Internal combustion engines, particularly diesel engines are dependent upon proper lubrication and proper cooling in order to operate. Such engines are usually manufactured with an engine oil pump and an engine oil sump. Lubricating oil is communicated from the engine sump to the engine oil pump wherein the lubricating fluid is pressurized to be communicated to various passages in the engine. The lubricant serves two purposes which are clearly interrelated. First the lubricant reduces friction between moving parts which by and of itself reduces engine temperature. The second purpose of the lubricant is to augment the cooling features of an engine. Since, in an internal combustion engine, heat is an inherent part of the engine, it is important to take advantage of every possible means for cooling the engine. Oil communicated to the various passages from the engine pump is returned to the sump either directly or in some cases in large engines through an engine oil cooler. In any event, the important factors of an engine lubrication system which are symptomatic of engine condition are engine oil pressure and engine oil temperature. A loss of engine oil pressure is a positive indication of potential engine failure. An increase in engine oil temperature, although not necessarily as critical a measure as a decrease of engine oil pressure, generally indicates a malfunction of some sort internally in the engine. In some cases an increase in engine oil temperature is an early indication of an engine oil leak.

Internal combustion engines of the type used in heavy construction equipment and the like generally are configured with a liquid coolant system. Such systems generally include a pump and a radiator, with the pump being driven by the prime mover. Liquid coolant is circulated through a jacket surrounding and usually integrally formed with the internal combustion engine wherein heat is picked up by the liquid coolant and is then circulated through a heat exchanger in the form of a radiator exterior of the engine. A fan is usually driven by the prime mover to circulate air through the radiator thus cooling the fluid for susbequent recirculation through the engine. Two common points of failure in a liquid coolant system are breakage of the coolant pump internal of the engine or loss of the fan drive to prevent cooling air being circulated through the radiator. In either event, or in the event of a puncture of the jacket or radiator with the consequent loss of cooling fluid, temperature of the remaining fluid rapidly increases with the concomitant rise in temperature of the engine itself. As previously indicated, an increase in temperature of the engine beyond a certain point results in early failure of the engine.

A third problem with internal combustion engines is associated with an overspeed condition. An overspeed can occur in an internal combustion engine, for example, as a result of the loss of the load on the engine. In a governed diesel engine the engine governor will usually protect the engine from overspeeding due to the loss of the load. Overspeeds occur in governed diesel engines because of a malfunctioning fuel system injecting excess fuel. A very likely possibility during an overspeed resulting from a fuel system malfunction is such rapid increase in engine speed that the operator is unable to shut down the engine before damage occurs. A loss of the load and a fuel system malfunction occurring simultaneously is especially serious. In the case of an engine driven heavy construction vehicle, this potential overspeed condition can occur during a long downhill run wherein the load is removed from the engine and the vehicle is free running. A similar overspeed condition can occur upon failure of the drive train of a heavy construction vehicle. In internal combustion engines utilized in a stationary environment, for example an engine driving a compressor or the like, a similar loss of load can occur on a failure of the drive train. Other events causing overspeed are well-known in the art. An overspeed condition can result in a catastrophic disassociation of the engine itself. Such failure is extremely hazardous to personnel working in the immediate vicinity in the engine, particularly a driver in a heavy construction vehicle who can be severely injured by such a failure.

Although it is possible for an operator to monitor the various gauges indicating engine oil pressure, engine oil temperature, coolant temperature and engine speed it is impractical to rely on continuous monitoring of the gauges during normal use of internal combustion engines. Furthermore, to rely on engine gauges themselves and consequent manual shutdown of an engine by an operator on knowledge of high oil pressure, high oil temperature, and the like has not proved reliable in every case. An over-zealous operator can be tempted to continue to operate his internal combustion engine notwithstanding a low oil pressure indication or a high engine coolant temperature indication or an overspeed indication. This, of course, assumes the operator has noted the condition. An overspeed indication is particularly insidious as momentary losses of loads can result in an overspeed condition. Although a single overspeed condition may not result in an immediate engine failure it is probable that a series of engine overspeeds could adversely affect the fatigue life of the various moving parts in the engine. Thus, it is appropriate to provide some means of stopping the engine upon an overspeed condition to reconnect the load or if necessary to allow for possible inspection of the moving parts before the engine is restarted. It is also appropriate to provide for stoppage of the engine upon sensing of low oil pressure or high engine coolant temperature for the same reason.

A particular problem, however, is associated with low oil pressure. An internal combustion engine is designed to operate at a normal or optimum speed wherein the engine oil pressure should remain above a minimum level. However, during certain periods between normal high r.p.m. periods of operation it is convenient to allow the engine to continue to run at a low r.p.m. or at an "idle" setting. Since the engine oil pump is generally driven directly by the engine, engine oil pressure becomes, in part, a factor of engine r.p.m. Therefore, at the low r.p.m. or "idle" setting, engine oil pressure usually will be below the minimum engine oil pressure for normal or optimum r.p.m. speeds. The engine, nevertheless, needs lubrication at the "idle" setting in the same manner it needs lubrication at the normal setting. Therefore it is appropriate to have a dual level engine oil pressure cutoff capability. This not only provides for a better system, it can preclude necessary override features of earlier engine cutoff systems. Such override systems were required because it was necessary to establish a certain level of oil pressure before the automatic cutoff feature could be utilized.

SUMMARY OF THE INVENTION

The present invention is directed to overcoming one or more problems as set forth above.

According to the present invention an emergency shutoff device for internal combustion engines is provided which will terminate either fuel supply or air supply or both when the engine exceeds certain predetermined operating limitations, including predetermined operating limitations while the engine is operating in an idle condition.

Broadly stated, the invention is in combination with an internal combustion engine having fuel shutoff means and air shutoff means, each operable for blocking fuel and air supply to the engine. The engine has a pressurized lubrication system and a liquid coolant system. The engine shutoff device comprises a housing, and an unpressurized source of fluid. Contained in the housing is a fluid pump driven by the engine for pressurizing the fluid. The housing defines a first circuit network for communicating pressurized fluid from the fluid pump to the source. A first valve means is interposed in the first circuit network and is operably responsive to engine oil pressure for allowing communication of pressurized fluid from the fluid pump to the source while the engine oil pressure is greater than a first predetermined pressure. A second valve means is also interposed in the first circuit network in a parallel arrangement with the first valve and also is operably responsive to engine oil pressure for allowing communication of pressurized fluid from the fluid pump to the source while the engine oil pressure is greater than a second predetermined pressure greater than the first predetermined pressure. Fuel lock means are interposed in the first circuit network between the fluid pump and the first and second valve means in the first circuit network and are responsive to increased pressure in the first circuit passage means for operating the fuel shutoff means to block fuel to the engine.

These and other objects of the invention will become apparent from a study of the following specification and the accompanying drawings.

DETAILED DESCRIPTION OF THE PREFERRED EMBODIMENT

Figure 1:
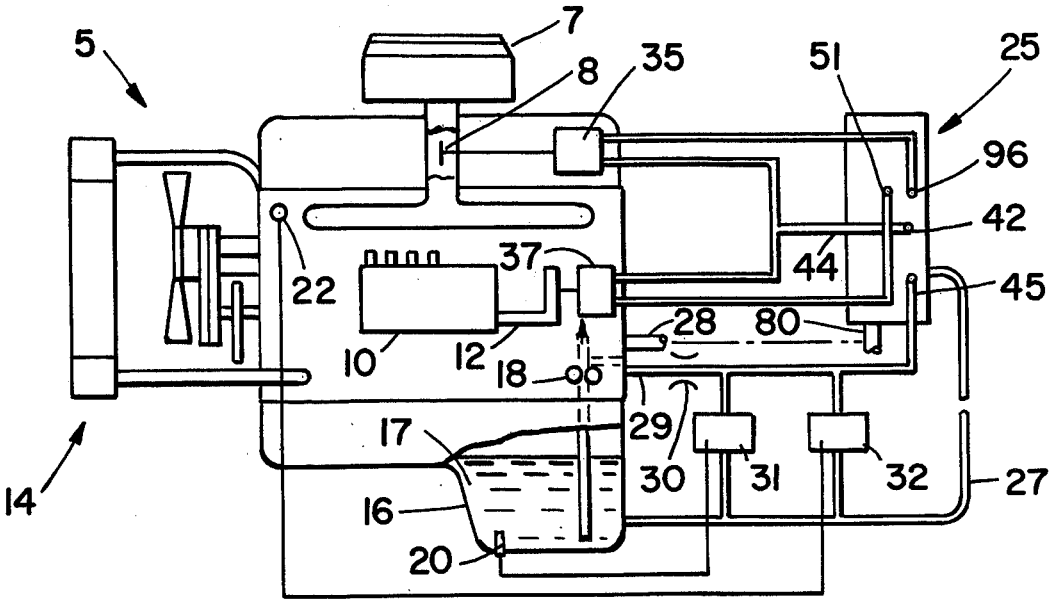
FIG. 1 illustrates schematically the engine shutdown device described herein coupled with an internal combustion engine.

An internal combustion engine 5 is illustrated in FIG. 1. Internal combustion engine 5 is equipped with an air intake arrangement 7 which may include an air filter and will include an air shutoff valve 8 shown schematically in a broken away portion of air intake arrangement 7. Air shutoff valve 8 may be of the type well-known in the art and requires no further explanation other than it may be actuated externally by a mechanical means. Internal combustion engine 5 is also provided with a fuel source (not shown) and a fuel distribution system shown in this embodiment as an injector pump 10. Although injector pumps are commonly associated with diesel engines, it is to be understood that this engine shutoff device would be equally applicable to a spark ignited engine either with a fuel injection system or where the injector pump is replaced by a conventional fuel pump. In the diesel environment, the injector pump 10 is also provided with conventional operating devices such as fuel rack 12 which controls particular nozzles associated with each cylinder.

Internal combustion engine 5 may also be equipped with a liquid cooling system 14 which may include a radiator, an engine driven fan and necessary piping interconnecting the radiator with the engine. The liquid cooling system, by means of an engine driven cooling pump, circulates cooling fluid through the engine and the radiator.

Internal combustion engine 5 is equipped with a source of lubrication fluid such as an oil sump 16 in which unpressurized lubrication fluid 17 is stored. Oil pump 18 which may be engine driven draws lubrication fluid from sump 16 to supply the various engine components. Oil sump 16 may include an oil temperature sensing device 20. Similarly, a water temperature sensing device 22 may be affixed in the cooling jacket at an appropriate position.

Engine shutoff device 25 which is the subject of this invention is interconnected with oil sump 16 of engine 5 by means of a conduit 27. It is an important feature of this device that it maintains its own oil pressure. Accordingly, the engine shutoff device, although shown positioned schematically in FIG. 1 above engine 5 would be positioned relative the engine so that upon supplying lubrication fluid 17 to the engine, engine shutoff device 25 receives an adequate supply of lubrication fluid from the engine to properly operate. This requirement will become more apparent in the following discussion. Conduit 27 is shown broken in FIG. 1 to indicate the positioning of engine shutoff device is schematic only. Engine shutoff device 25 is also interconnected with the engine by means of an engine driven shaft 28, the purpose of which will become apparent in the ensuing discussion. A conduit 29 provides pressurized lubrication fluid through a restriction 30 to engine shutoff device 25. Two temperature actuated valves 31 and 32 are affixed in parallel relation between conduit 29 and conduit 27 upstream of engine shutoff device 25 and downstream of restriction 30. One of these temperature actuated valves, for example 31 which is normally closed, may be interconnected with the oil temperature sensing device 20 while the other normally closed temperature actuated valve 32 may be interconnected with the water temperature sensing device 22. Each of the temperature actuated valves 31 and 32 is set to open at the maximum operating temperature of the particular fluid to which it is associated so that pressurized fluid from oil pump 18 passes through conduit 29, restriction 30 and during periods of excessive temperature is bled directly to conduit 27 back to sump 16 thus bypassing engine shutoff device 25. The purpose of this bleed off will become more apparent in the discussion of engine shutoff device 25.

Also mounted on internal combustion engine 5 is an air shutoff valve actuator 35 which is conventional in design and is responsive to an increase in pressure to close air shutoff valve 8 thus depriving internal combustion engine 5 of air. Similarly a fuel shutoff device in the form of a fuel rack actuator 37 is mounted on engine 5 and is also of conventional design. The actuator 37 is responsive to an increase in pressure to move fuel rack 12 to the shutoff position.

Figure 2:
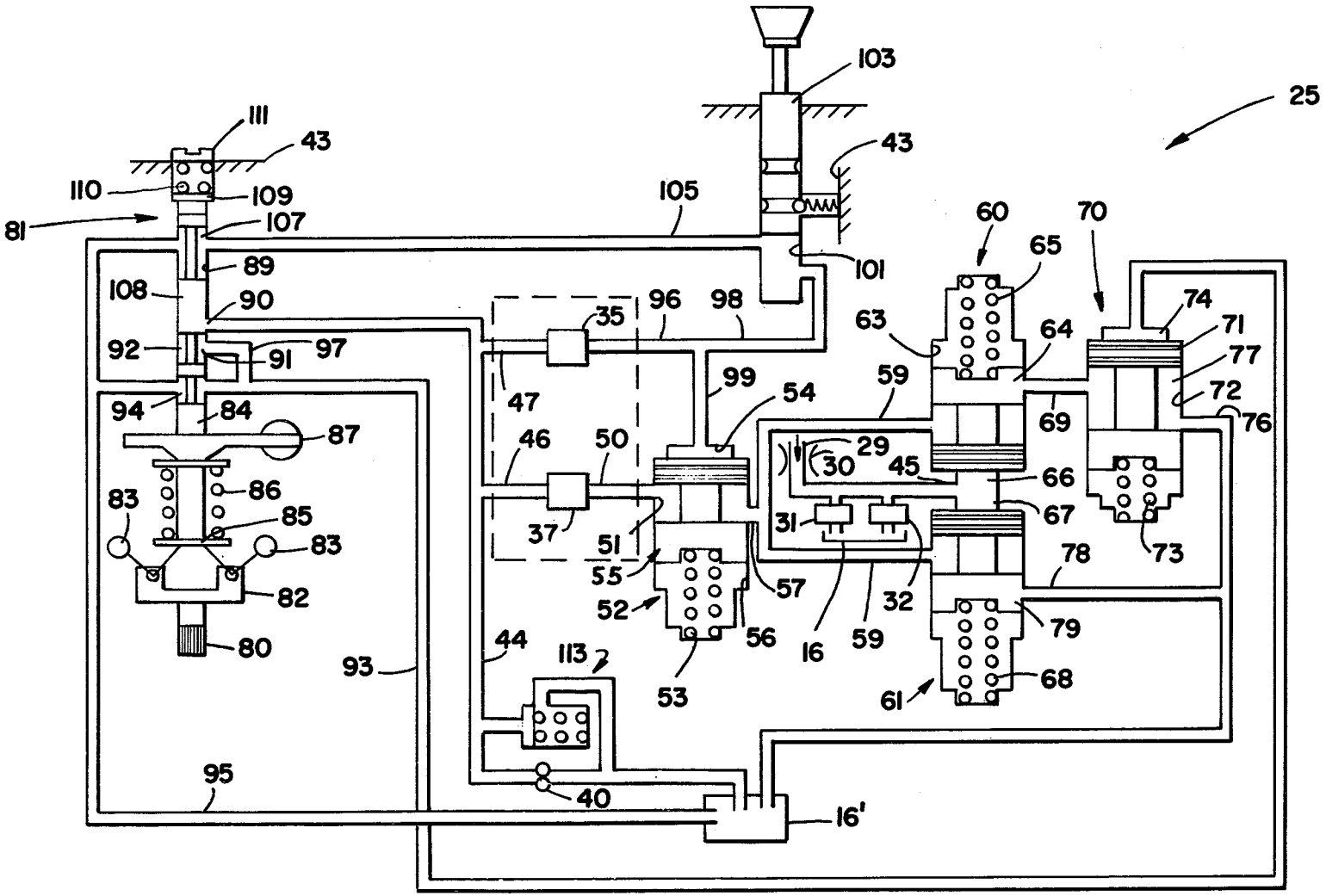
FIG. 2 is a schematic diagram of the engine shutdown device with the engine stopped.

Referring now to FIG. 2, engine shutoff device 25 is shown schematically. Certain portions previously described with reference to the engine are repeated in FIG. 2 for clarity sake, for example, conduit 29 supplying oil pressure to engine shutoff device 25 along with the temperature actuated valves 31 and 32 are shown in FIG. 2. Similarly the air shutoff valve actuator 35 and the fuel rack actuator 37 are also shown schematically. In amplification of air shutoff valve actuator 35 and fuel rack actuator 37 these systems could in part each take the form of a hydraulic cylinder biased to the open position as shown schematically in FIG. 11.

Engine shutoff device 25 is provided with its own internal oil sump 16', which receives oil from the main oil sump 16 of the engine. Therefore, the device is not fully dependent upon having a full engine oil sump 16. Thus, loss of oil in internal combustion engine 5 has no immediate effect on engine shutoff device 25. Similarly, engine shutoff device 25 has integrally formed therein its own engine driven oil pump 40 driven by shafts 28 and 80 from internal combustion engine 5.

Engine shutoff device 25, with the exception of those portions enclosed by dotted lines and shown in FIG. 1 as being affixed to internal combustion engine 5, is contained in a housing 43, portions of which are shown in FIG. 2 and which will be described in further detail in relation to a particular embodiment. Housing 43 defines in part a first circuit passage means communicating pressurized fluid from pump 40 through a plurality of pressure sensitive valves to a sump 16'.

The first circuit passage means and the associated valves serve to terminate fuel flow to the engine by operating the fuel rack actuator 37 upon excessive engine temperature or upon low oil pressure. From pump 40, a passage 44 leads to branch conduits 46 and 47 feeding respectively fuel rack actuator 37 and air shutoff valve actuator 35, both exterior of housing 43 (see also FIG. 1 and FIG. 11). Conduit 46 is provided with orifice means 48 downstream of the fuel rack actuator 37 to restrict flow in conduit 46. Paying particular attention to the return of pressurized fluid from fuel rack actuator 37, the first circuit passage means includes a conduit 50 which communicates to a port 51 in housing 43 leading to an interface valve 52 biased in the open position by a resilient member 53 and formed with a pilot chamber 54 at the end opposite resilient member 53. A spool member 55, reciprocally mounted in a bore 56 of interface valve 52, is grooved to communicate fluid pressure provided at port 51 to a port 57 with the interface valve biased in the open position. Port 57 is axially displaced from port 51 so that with pilot fluid provided to pilot chamber 54, port 51 is closed and communication is cut off across interface valve 52.

Port 57 feeds a branched passage means 59 in housing 43, the branches of which feed similarly constructed oil pressure sense valves 60 and 61. Oil pressure sense valve 60 and oil pressure sense valve 61 are essentially identical in construction and differ only in the biasing means provided to urge the valve spool therein in a particular direction.

Oil pressure sense valve 60 is formed with a bore 63 defined in housing 43 and has a positioned therein a reciprocally mounted spool 64 biased toward one end of bore 63 to a closed position by a resilient member 65. At the end opposite resilient member 65 is a pilot chamber 66 which communicates with the engine oil pump via conduit 29 and port 45 in housing 43. As previously noted, oil pressure sense valve 61 is similar in construction to oil pressure sense valve 60 and is also provided with a pilot chamber 67 in communication with the engine oil pump through conduit 29 and passage 45. Oil pressure sense valve 61 is similarly resiliently biased toward pilot chamber 67 by a resilient member 68. With oil pressure sense valve 60 in the closed position, that is, without pressure in pilot chamber 66, communication through the valve from passage means 59 to a passage means 69 is blocked by the spool member 64. Application of pressure to pilot chamber 66 urges spool member 64 upwardly and communicates passage means 59 to passage 69 which in turn communicates with a spool selector valve 70 which forms the last valve member in the first circuit passage means.

Selector valve 70 is comprised of a spool member 71 reciprocally mounted in a bore 72 defined in housing 43. Spool member 71 is biased in one direction to an open position by a resilient member 73 and is formed with pilot chamber 74 at the end of opposite resilient member 73 to enable the spool member 71 to be urged downwardly as indicated in FIG. 2 against resilient member 73. Passage 69 is communicated to a corresponding axially displaced passage 76 by a groove 77 in spool member 71 with the spool resiliently biased to the open position as indicated in FIG. 2. Passage 76 communicates with sump 16'.

Oil pressure sense valve 61 communicates fluid pressure from branch passage 59 to a passage 78 when pressure is provided to pilot chamber 67 sufficient to move spool 79 downwardly against the biasing of resilient member 68. Passage 78 also communicates with sump 16'.

Passage 44 also provides fluid pressure to a second circuit passage means which includes a speed sense arrangement and which interacts with the aforedescribed valve spools to make the device responsive to an overspeed condition. Also included in the second circuit passage means is a manual shutoff device which will block fluid pressure through the second circuit passage means.

Rotatably mounted in housing 43 is a rather conventional speed sensing device comprising a shaft 80 driven by engine 5 by shaft 28 which drives a fly weight carrier 82 upon which a plurality of fly weights are mounted. Co-axially mounted with shaft 80 is a fly weight valve assembly 81 including a fly weight valve spool 84 formed with a bearing plate 85 abutting the conventional fly weight mounting arms so that rotation of shaft 80, which causes fly weights 83 to move outwardly, will urge the fly weight valve spool 84 upwardly as indicated in FIG. 2. A fly weight speeder spring 86 is provided along with a speeder spring adjustment lever 87 to urge the bearing plate and fly weight valve spool 84 downwardly in the conventional manner of speed sensitive spool valves. Fly weight valve spool 84 is reciprocally mounted in a bore 89 defined in housing 43. Fly weight valve spool 84 is formed with a plurality of grooves to intercommunicate various passages also defined in housing 43 upon reciprocal movement of the fly weight valve spool in bore 89. In particular, passage means 44 communicates to bore 89 at a port 90 which is blocked by fly weight valve spool 84 with the engine stopped. A port 91, axially adjacent to port 90 in bore 89, is communicated to port 90 by a groove 92 formed in the fly weight valve spool when the fly weight valve spool is urged upwardly upon rotation of the engine. Port 91 communicates with a branched passage 97 which in turn leads to a passage 93 communicating with pilot chamber 74 of selector valve 70. A second groove 94, in fly weight valve spool 84, communicates passage 93 to a drain passage 95 leading to sump 16' when fly weight valve spool 84 is in the at rest position as indicated in FIG. 2. Thus, it can be seen that fluid pressure from pump 40 if it were available would not be communicated to pilot chamber 74 in selector valve 70 with the engine stopped.

A second passage branches from passage 44 in the second circuit passage means to pass through valve 140 exterior of housing 43 and to feed air shutoff valve actuator 35. Fluid is returned to the engine shutoff device through a port 96 which feeds a passage 98 defined in housing 43. Passage 98 further feeds a branch passage 99 communicating with pilot chamber 54 of interface valve 52. Passage 98 communicates with a bore 101 having a manual shutoff valve spool 103 reciprocally mounted therein. Also communicating with bore 101 is a passage 105. Manual shutoff valve spool 103 is movable in bore 101 to block communication from passage 98 to passage 105. In the normal operating position manual shutoff valve spool is as indicated in FIG. 2, in the upward position, to allow communication between passage 98 and passage 105. Passage 105, also defined in housing 43, communicates with bore 89 of the fly weight valve assembly 81. Fly weight valve spool 84 is formed with a groove 107 which communicates passage 105 with passage 95 and thus sump 16'. As fly weights 83 move outwardly to urge fly weight valve spool 84 upwardly as speed of the engine increases, the spool is designed to contact an overspeed spring seat 109 which is urged downwardly by an overspeed spring 110 adjustable by an adjustment means 111 associated with housing 43. As fly weight valve spool 84 moves upwardly against the bias of overspeed spring 110, a land 108 formed on fly weight valve spool 84 closes passage 105 from communication with passage 95 thus allowing pressure to increase in passage 105 at a predetermined overspeed condition. The purpose of this will become more apparent in the discussion of the operation of the device.

In view of the fact that operation of this engine shutoff device is dependent upon increasing pressure in either the first circuit passage means due to low oil pressure, high coolant temperature or high oil temperature or due to an overspeed condition causing an increase in pressure in the second circuit passage means, the device is provided with a safety relief valve means 113 allowing relief of pressure in passage 44 upon reaching a predetermined pressure level.

Figure 11:
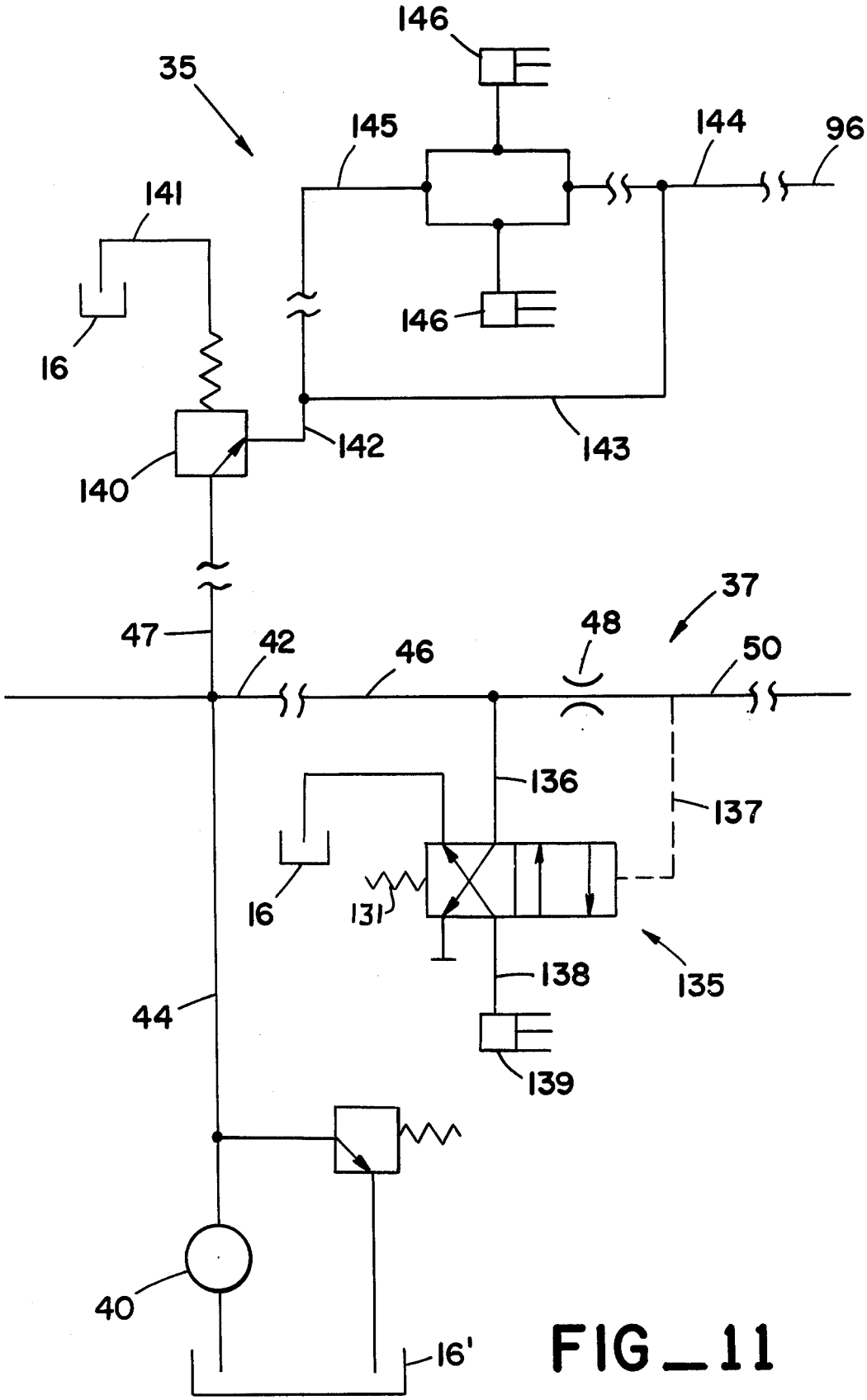
FIG. 11 is a schematic diagram of an air shut off actuator and a fuel rock actuator which may be used with the engine shutdown device.

Referring to FIG. 11, a fuel rack actuator 37 and an air shut off valve actuator 35 are shown schmeatically. It is again pointed out that these devices may be remote of the engine shut off device and may comprise several components. The arrangement to be described is representative only and other systems responsive to increases of fluid pressure would be equally applicable.

Branch conduit 46 communicates fluid from passage 44 to fuel rack actuator 37 which may include pilot operated check valve 135 in a conduit 136 branching off conduit 46 and upstream of an orifice 48 disposed in conduit 46. Pilot pressure for check valve 135 is obtained downstream of orifice 48 from a branch conduit 137 communicating with conduit 50. Pilot operated check valve 135 may be a two position four way valve resiliently biased to a closed position to prevent fluid pressure from passing through the valve to a conduit 138 which communicates with a linear fluid motor 139 associated with fuel rack 12 (see FIG. 1). If fluid pressure is permitted to increase in conduit 50 such pressure is communicated to the pilot chamber of check valve 135 to urge that valve leftwardly as shown in FIG. 11 and allow pressure in conduit 46 to pass into the linear fluid motor 139 and thus close fuel rack 12. Once pressure is relieved in conduit 137, check valve 135 will return to the position indicated in FIG. 11 to allow fluid in linear motor 139 which may be resiliently biased by spring 131 to return to sump 16.

The second branch conduit 47 from passage 44 feeds a pressure relieving sequence valve 140 which is set to open at a pressure substantially below that of safety relief valve 113 positioned in housing 43. Thus pressure relieving sequence valve 140 is the pressure determinant for system operation. Other pressure regulating means, such as an orifice, may also be used, however, a pressure relief type valve gives more control over system pressure. Sequence valve 140 may be provided with a vent 141 in the biasing portion of the valve to allow bleed off of accumulated fluid to sump 16.

A conduit 142 leads from the downstream side of sequence valve 140 to a branching bypass conduit 143 communicating directly with a conduit 144 leading to passage 96.

Conduit 142 also communicates with a conduit 145 for operation of means such as linear motors 146 to close air shut off valve 8 upon an increase in pressure in conduit 145. Downstream of the means for shutting air valve 8 conduit 145 communicates with conduit 144.

The described air shut off valve actuator has been found adaptable to varying oil viscosity conditions. Under low viscosity conditions sequence valve 140 maintains system pressure. Conversely under high viscosity conditions, such as during a cold start, the bypass 143 which may be considerably shorter than conduit 145 maintains oil in the air shut-off side of the circuit.

OPERATION

Reference is made to FIGS. 2, 3, 4, 5 and 11 for a better understanding of the operation of the engine shutoff device 25.

Figure 3:
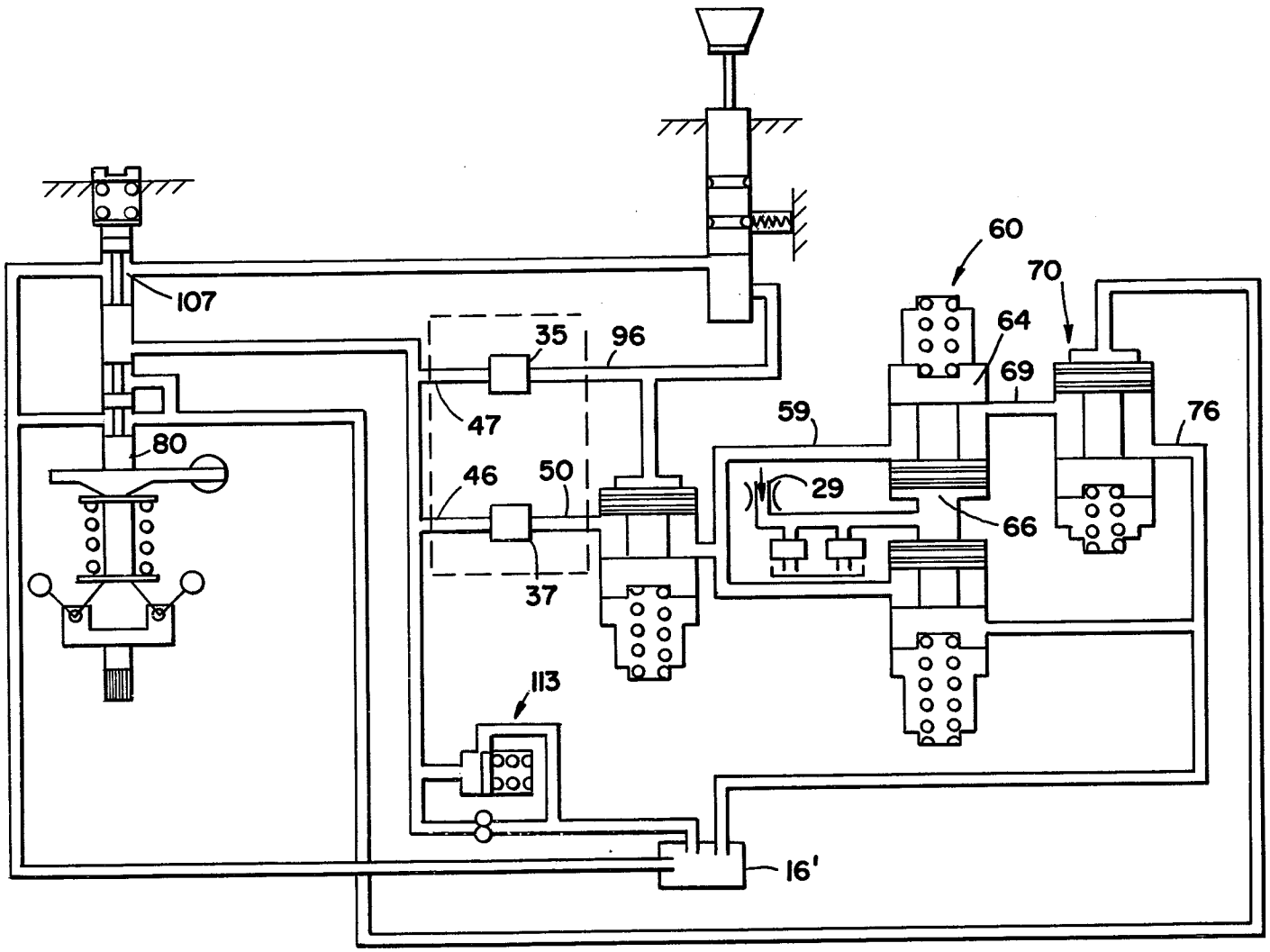
FIG. 3 is a schematic diagram of the same engine shutdown device illustrated in FIG. 2 with the engine idling.

As noted earlier, FIG. 2 indicates the positioning of the various valve members and the speed sense means with the engine in a stopped position. It is also to be understood that air shutoff valve actuator 35 and fuel rack actuator 37 are operable on an increase in pressure to respectively terminate air supply to the engine or terminate fuel supply to the injectors of a diesel engine. Thus, with the engine at rest, no pressure exists in either air shutoff valve actuator 35 or fuel rack actuator 37. Referring specifically to FIG. 2, it can be seen that oil pressure sense valve 60 and oil pressure sense valve 61 block communication through the first circuit passage means so that pressure can build up in fuel rack actuator 37. On the other hand, groove 107 of fly weight spool 84 permits communication from passage 44 through conduit 47, through air shutoff valve actuator 35 after sequence valve 140 opens and thence passages 98, 105 and 95 to sump 16' to prevent pressure actuation of air shutoff actuator 35. At start-up, the first circuit passage means is prevented from shutting down the engine immediately by a combination of orifice 48 which slows the pressure build up in the first circuit passage means sufficiently to allow engine oil pressure at conduit 29 to build sufficiently to urge spool 64 of oil pressure sense valve 60 upwardly against resilient member 65. Resilient member 65 is purposely formed with a lower coefficient of elasticity than resilient member 68 so that spool 64 moves upwardly under the urging of engine oil pressure at idle in pilot chamber 66 before spool 79, as indicated in FIG. 2, moves downwardly. If oil pressure is not delivered within a predetermined period of time dependent in part upon the size of orifice 48, the resilient biasing of check valve 135 the capacity of interface valve 52 and the two oil pressure sensing valves, the pressure builds up in fuel rack actuator 37 sufficiently to shut off fuel to the engine so that before a second attempt at engine start-up can occur the check valve 135 must return to the normal closed position and pressure must drain back into sump 16' through check valve 135. This provides a safety feature during start-up in that engine oil pressure is required to build to a sufficient point to open oil pressure sense valve 64 for sustained operation of the engine at an idle condition. This condition is indicated in FIG. 3 wherein oil pressure in pilot chamber 66 of low oil pressure sense valve 60 has reached a sufficient level to urge the valve spool 64 upwardly and open passage 59 to communication with passage 69. Selector valve 70 which is normally biased open allows communication between passage 69, passage 76 and sump 16'. Thus, pressure in the first circuit passage means is now relieved preventing actuation of fuel rack actuator 37 to shut off fuel to engine 5. It should be noted that at the idle condition denoted in FIG. 3, engine oil pressure is below normal for higher engine speeds. Furthermore, the speed of the engine at idle is insufficient to urge the fly weight spool 84 upwardly so that communication through air shutoff valve actuator 35 is permitted around groove 107 to fly weight spool 84 back to sump 16'. Thus pressure downstream of sequence valve 140 is not permitted to build up in the second circuit passage means.

Figure 4:
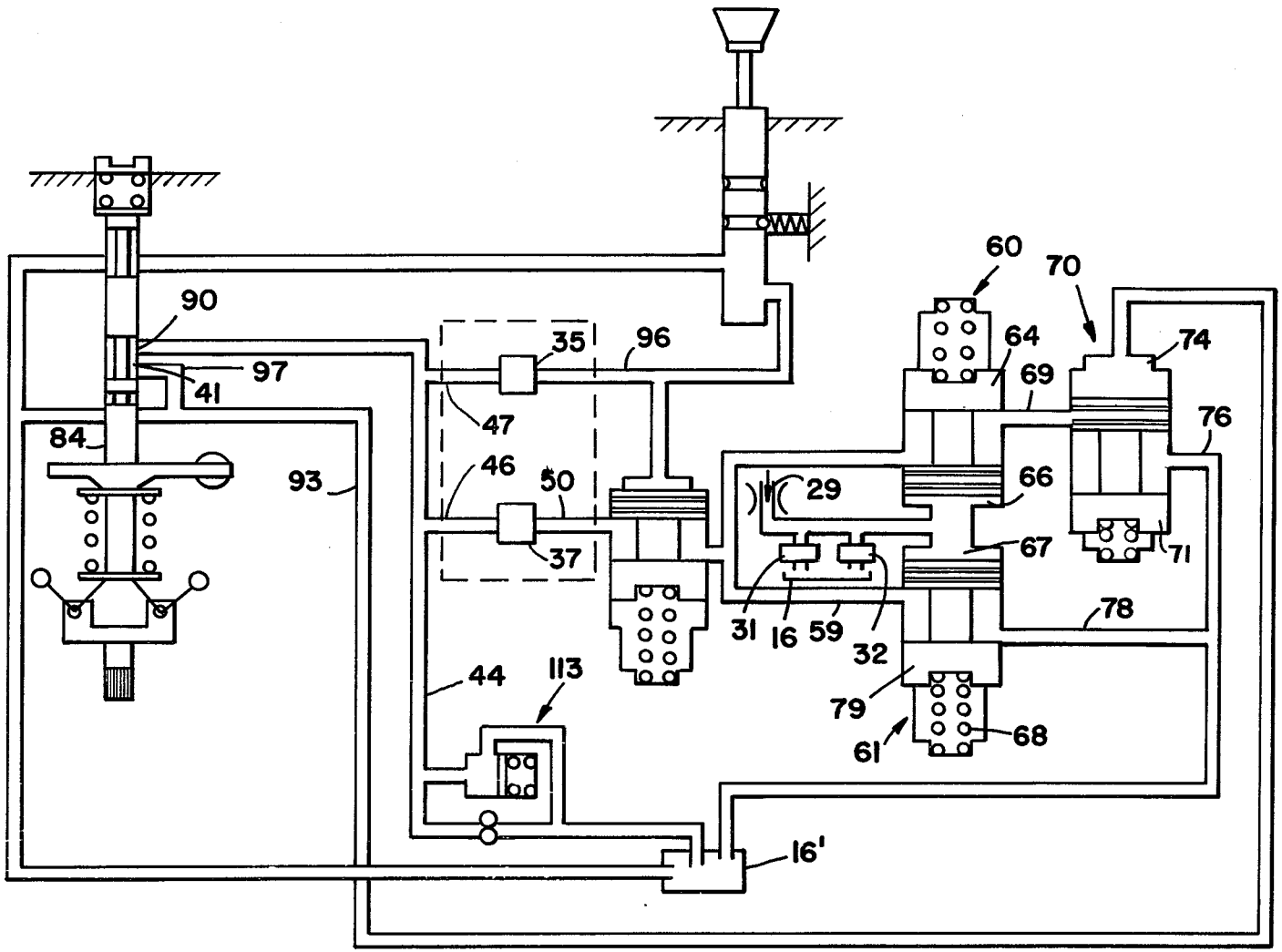
FIG. 4 illustrates diagrammatically the same engine shutdown device with the engine at a normal operating speed.

As the speed of engine 5 increases, fly weight spool 84 is urged upwardly as indicated in FIG. 4 to open port 90 which is fed from main passage 44. This in turn feeds branch passage 97 and thence passage 93 leading to pilot chamber 74 of selector valve 70, thus urging spool 71 of selector valve 70 downwardly to close passage 69 from passage 76. Simultaneously pressure in the engine lubricating system communicating to conduit 29 increases sufficiently to build pressure in pilot chamber 67 and urge high oil pressure sense valve 61 downwardly to open branch passage 59 to passage 78 and thence sump 16' to relieve pressure in first circuit passage means.

It should be apparent at this point that a two step oil sense arrangement is provided in this engine shutoff device. The first pressure level is provided by a low oil pressure sense valve 60 operable at idle speeds and cut out by selector valve 70 upon attainment of a certain engine speed. Increased engine oil pressure is measured by a high pressure oil sense valve 61. A drop in the higher pressure in conduit 29 occurring while selector valve 70 is closed due to higher engine speeds results in resilient member 68 urging valve spool 79 upwardly to close passage 78 and thus build up pressure in first circuit passage means causing actuation of fuel rack actuator 37 to shut off fuel to the engine. Similarly, in the idle condition as explained above, a further drop in oil pressure, below the normal idle setting, allows valve spool 64 to move downwardly to block passage 69 and thus allow pressure to build up in the first circuit passage means and close the fuel rack actuator 37.

With the engine operating in normal ranges so that the valves take up the position as indicated in FIG. 4, provision may be included in the circuit to vent engine oil pressure in conduit 29 in the event of a high engine coolant temperature or a high oil temperature. As previously mentioned, a temperature actuated valve 31 is interconnected with the engine oil sump 16 so that excessive oil temperature will open valve 31 to vent oil pressure in line 29 to sump 16. A similar temperature actuated valve 32 is designed to be operably opened by a high engine coolant temperature to vent pressure in conduit 29 to sump 16. In either case, that is, a high engine oil temperature or a high engine coolant temperature, pressure is relieved from both pilot chamber 66 and pilot chamber 67. Thus, in the event high temperature occurs during idle operation or normal operation or the to be described overspeed condition, pressure is increased in branch conduit 59 and thus in rack actuator 37 to shut off fuel to the engine as previously described. It should be apparent to those in the art that over heat shut-down resulting from over speed is highly unlikely with an operable overspeed protection as heat build is too slow to be effective.

Figure 5:
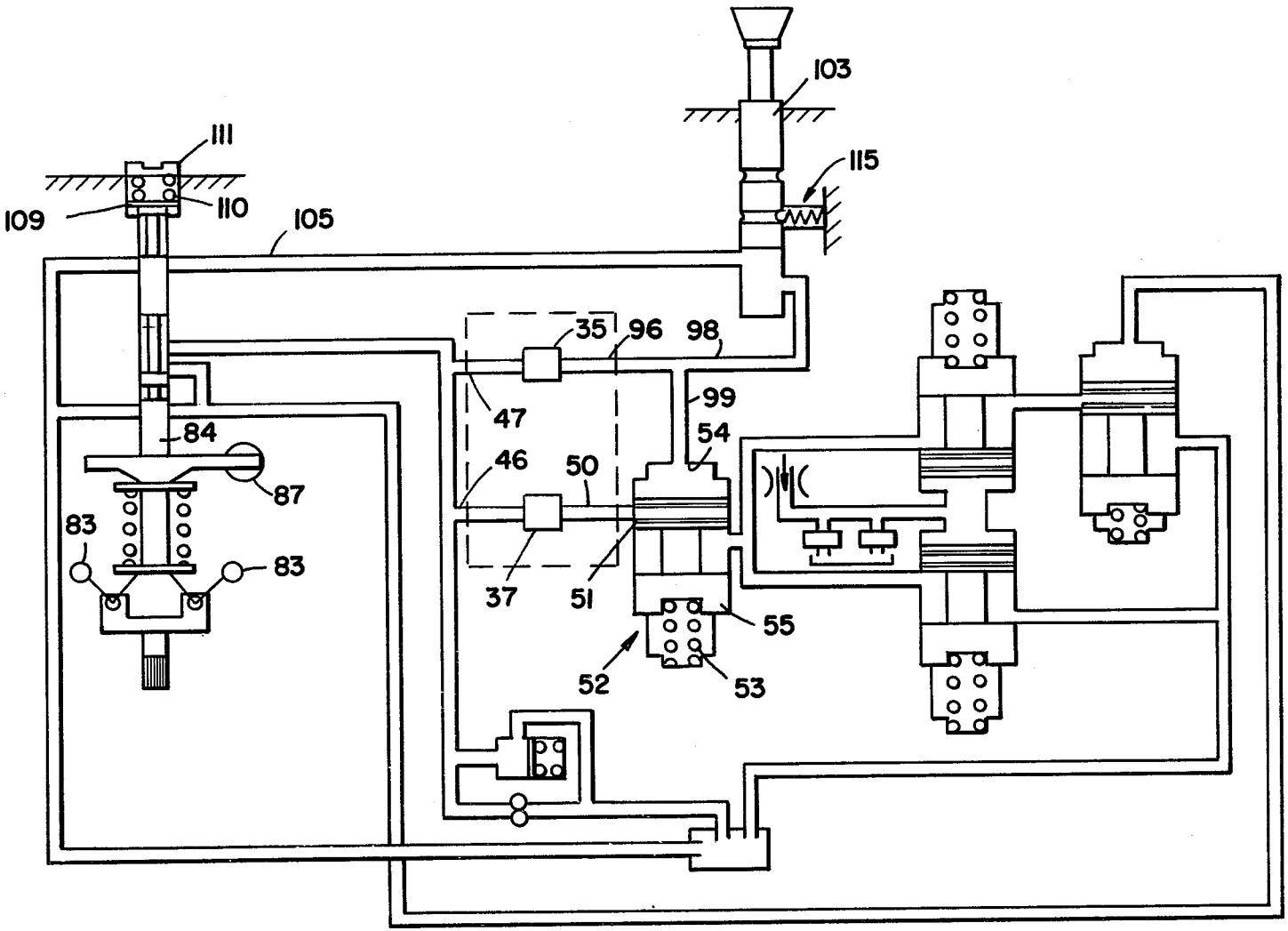
FIG. 5 illustrates diagramatically the same engine shutdown device with the engine operating in an overspeed condition.

Referring now to FIG. 5, the system is shown during an overspeed condition. In particular, fly weight valve spool 84 has been urged upwardly by the fly weights 83 acting in the conventional manner of an engine speed sensing device to block passage 105. It should be noted that fly weight valve spool 84 is urged upwardly against overspeed spring seat 109 and against overspeed spring 110. Thus, a separate adjustment means to affect the overspeed setting of the engine shutoff device is provided at adjustment means 111 in addition to the idle setting available in speeder spring adjustment lever 87. Blockage of fluid pressure in passage 105 acts on air shutoff valve actuator 35 to close air shutoff valve 8 and also through interface valve 52 to act on fuel rack actuator 37 in a manner to be described to cut off both air and fuel to the engine. It is important to note that both fuel and air are shut off in an overspeed condition because overspeed conditions are usually associated with failure of the fuel rack. Thus, to depend entirely on fuel shutoff would be inappropriate if the fuel rack itself has failed. Therefore this system has been designed to provide the shutoff of fuel and air in an overspeed. The pressure build up in passage 105 is reflected in passage 98 and branch passage 99 leading to pilot chamber 54 of interface valve 52. Pressure build up in pilot chamber 54 urges spool 55 downwardly against resilient means 53 to block port 51 of the first circuit passage means. Blockage at port 51 is reflected in the fuel rack actuator 37 in the manner heretofor described to terminate fuel flow to engine 5. Thus, in an overspeed condition it can be seen that both the air and the fuel is cut off to engine 5.

The engine shutoff device includes one other feature, a manual shutoff valve spool 103, which is interposed between passage 105 and passage 98 and is provided with a detent means 115 to hold the manual shutoff spool 103 in the upward or open position. Movement of manual shutoff valve spool 103 downwardly as indicated in FIG. 5 blocks communication from passage 98 to passage 105 and accomplishes essentially the same purpose as an overspeed condition by allowing pressure build up in both the air shutoff valve actuator 35 and the fuel rack actuator 37, thus terminating operation of the engine. Although manual shutoff valve spool 103 has been shown with a push button type arrangement in FIGS. 2, 3, 4 and 5 it is envisioned that other operating means such as a solenoid would be equally applicable.

This particular device has been shown operating in an environment that senses pressure and temperature in an engine and where the device is dependent upon self-developed pressure for operation. It should be apparent to those skilled in the art that other sensing devices to sense critical parameters may be placed in the circuit in parallel arrangement to the temperature actuated valves 31 and 32 to open conduit 29 to sump 16 thus to relieve pressure in conduit 29 and automatically shut down the engine. Similarly, other sensing devices can be included to block communication through passage 105 on information of excessive temperatures, or the like.

DESCRIPTION OF A PARTICULAR EMBODIMENT

Referring now to FIGS. 6, 7, 8, 9 and 10 a particular embodiment incorporating the provisions of the schematic diagram, and the description set forth above is shown with a degree of particularity. A brief description of those features previously described follows.

Figure 6:
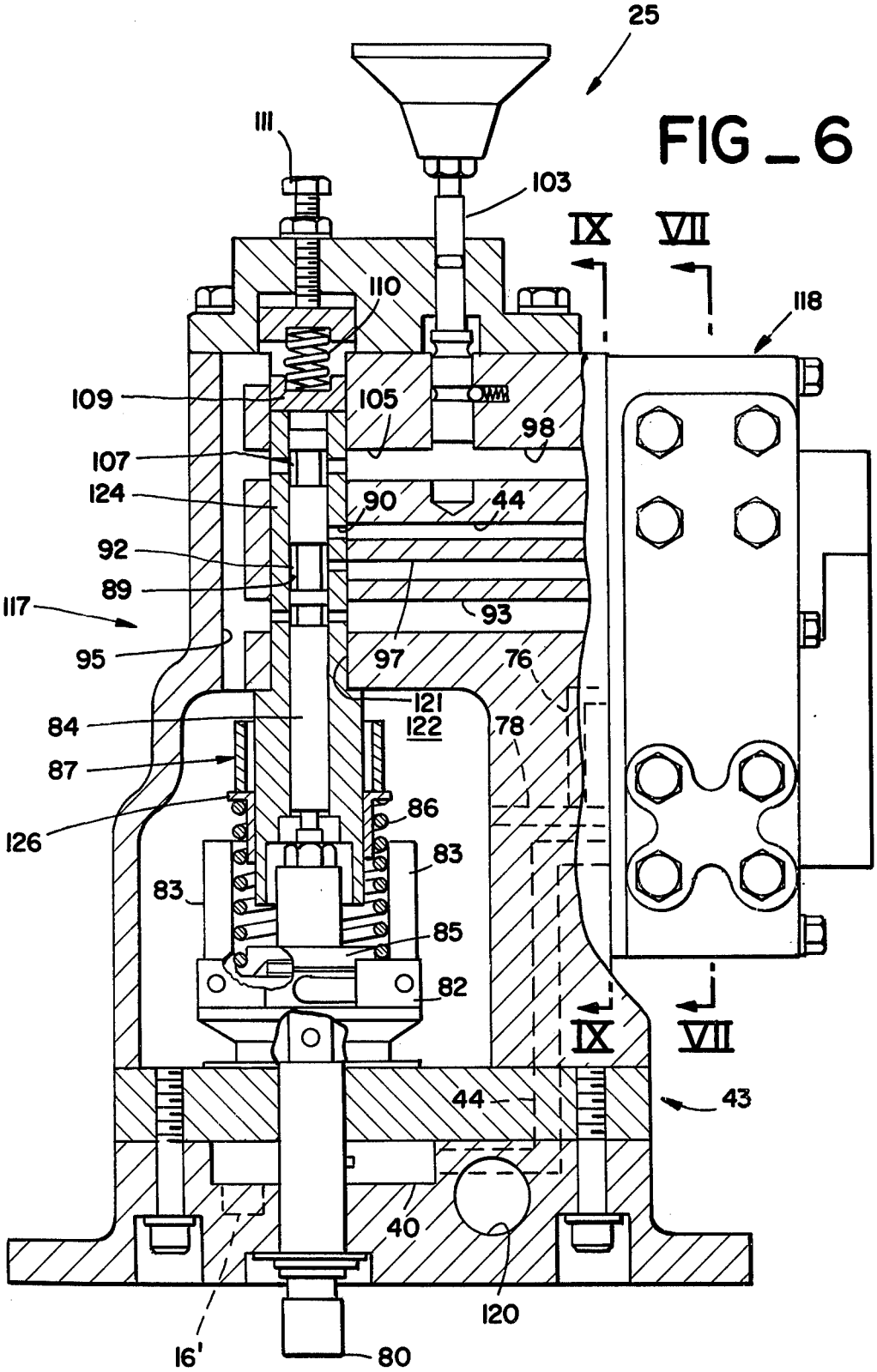
FIG. 6 is an elevation view of an engine shutdown device constructed in accord with the principles of this invention, a portion of which is shown in section as indicated at Line VI—VI of FIG. 7.

Referring now to FIG. 6, it can be seen that housing 43 is comprised of essentially two major portions, a governor and pump portion 117 and a valve portion 118.

Governor and pump portion 117 includes the governor section, the manual shutoff valve and certain passages associated with the second circuit passage means as described above. In addition, pump 40 along with sump 16' are located in the base of governor and pump portion 117. In particular, it is envisioned that pump 40 may take the form of a gear or vane type pump, the main rotating element of the pump being appropriately keyed to shaft 80. A self-contained sump 16' is also contained in governor and pump portion 117. Provision for relief valve means 113 to relieve excess pressure in passage 44 is made in a bore 120 while the main pressure passage 44 is shown in dashed lines in the lower part of the governor and pump portion 117, and in section in the upper part. Governor and pump portion 117 defines an interior cavity 122 in which the fly weights 83 and fly weight carrier 82 driven by shaft 80 and constituting portions of the previously described speed sensing device are free to rotate. Bearing plate 85 is also located in cavity 122 and bears against fly weight valve spool 84 which is reciprocally mounted in a vertically oriented bore 121 in governor and pump portion 117. Affixed in bore 121 is a sleeve member 124 defining an axial bore 89 and radially bored to communicate with internal bores forming the portions of the second circuit passage means to be described. Slidably mounted about sleeve 124 at the lower end thereof is a speeder spring bearing plate 126 upon which speeder spring adjustment lever 87 bears (see FIG. 10). A speeder spring adjusting means 128 extends outwardly of housing 43 for adjustment of compression in speeder spring 86.

Comparison of the structure in FIG. 6 to the schematic in FIG. 2 will show the top passage means 105 corresponds to the top passage means in FIG. 2, that is, the passage means interconnecting the manual shutoff valve 103 with the bore 89 at groove 107. The passage 44 which communicates with valve portion 118 in the lower part of FIG. 6 appears again communicating with valve spool 84. Also indicated are passages 92 and 93.

Figure 7:
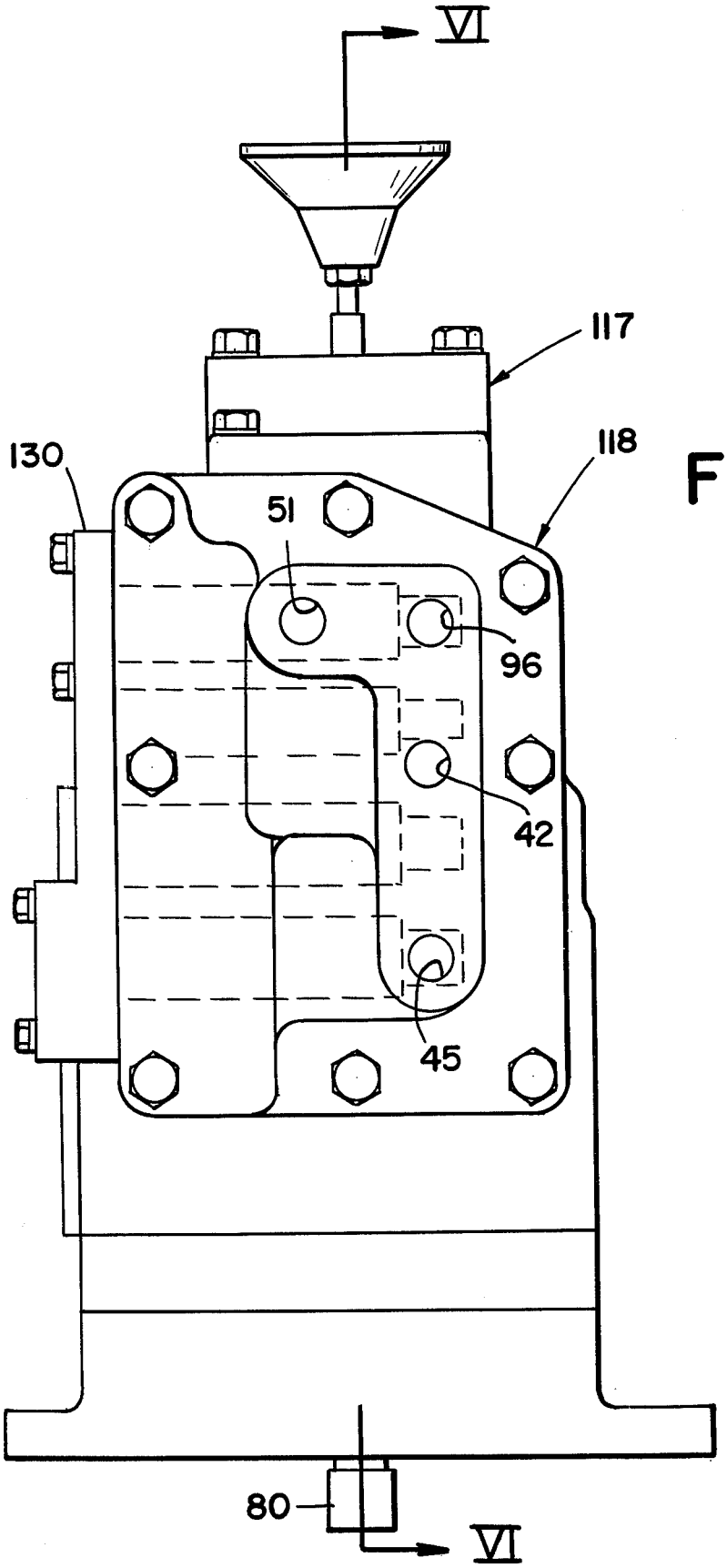
FIG. 7 is a side elevation view of the same engine shutdown device depicted in FIG. 6.
Figure 8:
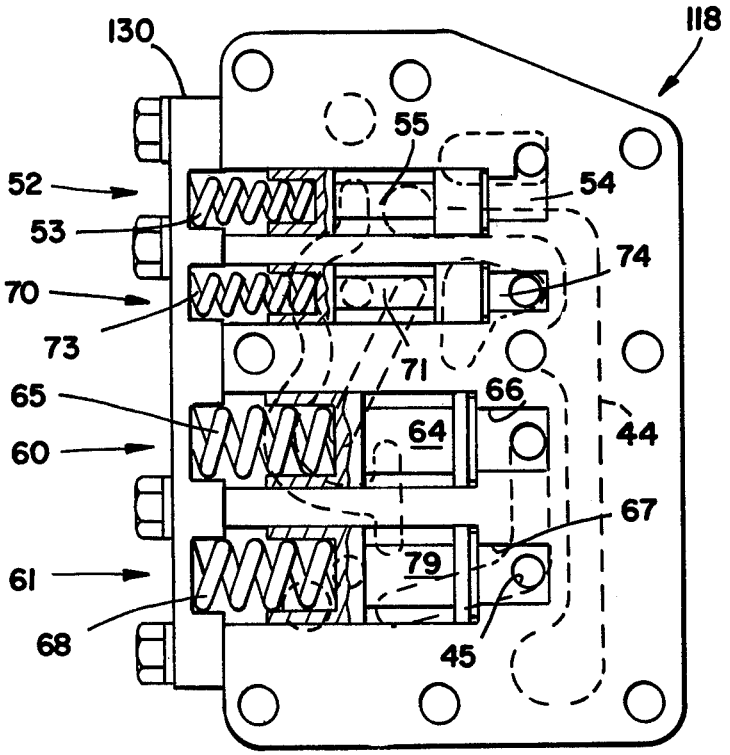
FIG. 8 is a sectional view taken at Line VII—VII of FIG. 6 of the valve structure of the engine shutdown device depicted in FIG. 6.
Figure 9:
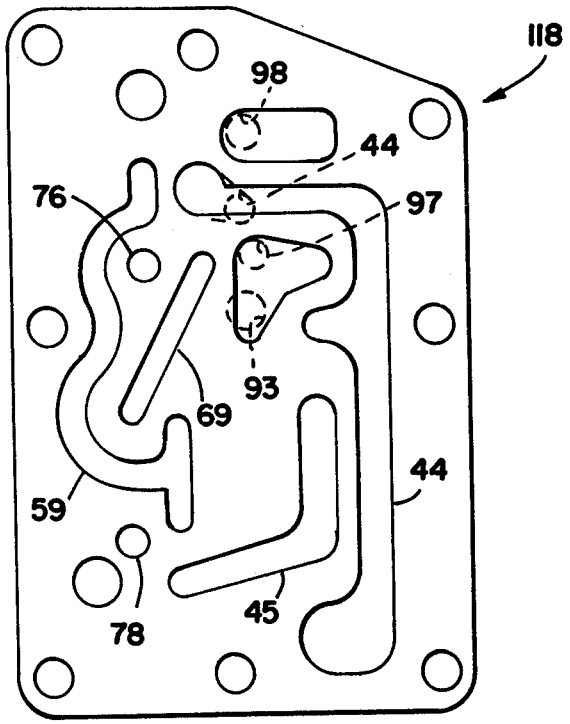
FIG. 9 is a sectional view of the porting of the engine shutdown device depicted in FIG. 6 and taken at Line IX—IX of FIG. 6.

Referring now to FIG. 7 in conjunction with FIGS. 8 and 9 an understanding of valve portion 118 can be attained. It should be noted that the passages discussed above in relation to governor pump portion 117 extend outwardly of the governor and pump portion 117 to meet with corresponding passages, as shown in FIG. 9, in the face of valve portion 118. Valve portion 118 is designed for alignment with these passages and reference is made to corresponding ports in the face of governor and pump portion 117. It is to be understood that appropriate gasket material would be interposed between valve portion 118 and governor and pump portion 117 to insure a proper fluid tight seal is maintained between these two portions. It should be understood that the valve elements in FIG. 8, which correspond to the valve elements shown in FIG. 2, are shown in the engine stopped condition. The passage means illustrated in FIG. 8 which correspond primarily to those passages found in the first circuit passage means are denoted in dashed lines and are found generally in FIG. 9. Port 51 which communicates fluid from the fuel rack actuator, port 96 which communicates fluid received from the air shutoff valve actuator, and port 45 which receives pressurized lubricating fluid from the engine by conduit 29 are all shown in FIG. 7. In addition, the port 42 leading to passage means 44 would be interconnected with passage means 46 and 47 shown in FIG. 2 for communicating respectively with the fuel rack actuator 37 and the air shutoff valve actuator 35.

Figure 10:
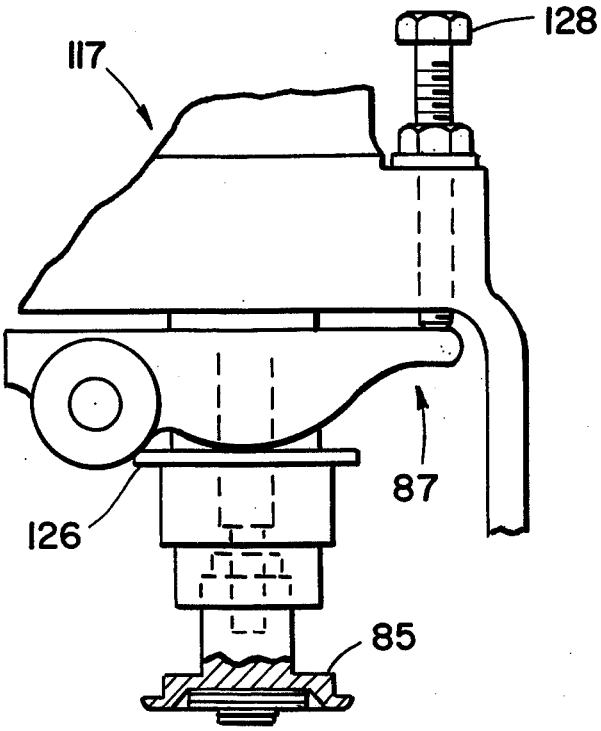
FIG. 10 is a detailed view of the speeder spring adjustment for the engine governor of the engine shutdown device depicted in FIG. 6.

Adjustment of the particular embodiment depicted in FIGS. 6, 7, 8, 9 and 10 may be accomplished externally by adjustment of the overspeed adjustment means 111, and speeder spring adjusting means 128 (see FIG. 10). The valve portion 118 is fitted with a cover plate 130 for retaining the respective resilient means for the four valve elements. Use of the cover plate 130 in this manner provides for a means to change the resilient members 53, 73, 65 and 68 as may be required to facilitate use of this device under different operating conditions.

The operation of the particular embodiment should be apparent, however, a brief description is offered herewith for clarity. On a normal start-up, fluid pressure is communicated to passage 44 from pump 40 for passage through interface valve 52 (see FIG. 8). Engine oil under pressure will arrive at port 45 to act on low pressure oil sense valve 60 at pilot chamber 66 before pressure builds in passage 50 sufficiently to close the fuel rack. Pressure in pilot chamber 66 opens valve 60 permitting shutoff device pressure fluid to pass low pressure oil sense valve 60 by way of passage 69 (compare FIGS. 8 and 9). Selector valve 70 remains in the position shown in FIG. 8 as the speed sense means has not reached a speed sufficient to open the fly weight valve spool to communicate shutoff device fluid through passage 92 to pilot chamber 74. Thus shutoff device fluid in passage 69 is communicated to passage 76, 78 and thus back to cavity 122 and sump 16'.

As engine speed increases, selector valve 70 will close if engine oil pressure is sufficient and the high pressure oil sense valve 61 will open thus communicating shutoff device fluid to passage 78 and back to sump 16'.

Loss of engine oil pressure will close either valve 60 or 61 dependent on engine speed causing a build up of shutoff device fluid pressure at port 51 to cause rack actuator 37 to shut off fuel to the engine. Similarly, an overheat condition will bypass engine oil pressure to sump 16 of the engine thus allowing valves 60 and 61 to close with the same fuel shutoff occurring. In an overspeed condition fly weight valve spool 84 blocks passage 105 causing interface valve 52 to close. Shutoff device fluid pressure build-up in passage 105 acts on air actuator 35 to close air shutoff valve 8. Simultaneously, fuel rack actuator 37 is shutting off fuel because shutoff device fluid pressure in pilot chamber 54 closes the interface valve 52 to allow shutoff device fluid pressure to build up at port 51.

Although this invention has been described with particularity in relation to a particular embodiment, it is to be understood that the invention is not to be so limited, but rather is to be limited only by the appended claims.

The embodiments of the invention in which an exclusive property or privilege is claimed are defined as follows:

1. In an internal combustion engine having fuel shutoff means and air shutoff means each operable for respectively blocking fuel and air supply to the engine, the engine further having a pressurized lubrication system and a liquid coolant system; an engine shutoff device comprising:

a housing;

an unpressurized source of fluid;

engine driven fluid pump means mounted in said housing for pressurizing said fluid;

the housing defining first circuit passage means for communicating pressurized fluid from the engine driven pump means to the source;

first valve means interposed in said first circuit passage means and operably responsive to engine oil pressure for allowing communication of pressurized fluid from said engine driven pump means to said source while said engine oil pressure is greater than a first predetermined pressure;

second valve means also interposed in said first circuit passage means in a parallel arrangement with said first valve means and operably responsive to engine oil pressure for allowing communication of pressurized fluid from said engine driven pump to said source while said engine pressure is greater than a second predetermined pressure, the second predetermined pressure being greater than said first predetermined pressure; and, fuel lock means responsive to pressure in said first circuit passage means for operating the fuel shutoff means to block fuel to said engine.

2. The combination of claim 1 wherein the engine shutoff device further comprises:

speed sense valve means responsive to engine speed;

pilot operated selector valve means including a pilot chamber interposed in the first circuit passage means between the first valve means and the source; and the housing further defining second circuit passage means for communicating pressurized fluid from the engine driven pump means to the speed sense valve means and from the speed sense valve means to the pilot chamber of the selector valve means;

said speed sense valve means allowing communication of fluid between said engine driven pump means and the pilot chamber of said selector valve means at engine speeds greater than a first predetermined speed, said selector valve means responsive to fluid pressure received at said pilot chamber from said speed sense valve means for blocking communication of pressurized fluid between said first valve means and said source.

3. The combination of claim 2 wherein the second circuit passage means further comprises an overspeed subcircuit passage means for communicating fluid pressure from the engine driven pump means to the source and further wherein the speed sense valve means blocks said overspeed subcircuit passage means at engine speeds greater than a second predetermined speed, said second predetermined speed greater than the first predetermined speed;

the combination further comprising air lock means interposed in said overspeed subcircuit passage means between said engine driven pump means and said speed sense means and responsive to increased pressure in said second circuit passage means for operating the air shutoff means to block air to the engine.

4. The combination of claim 3 wherein the engine shutoff device further comprises pilot operated interface valve means interposed in the first circuit passage means between the fuel lock means and the first and second valve means, and further wherein the housing defines interface passage means communicating the overspeed subcircuit passage means downstream of the air lock means with the pilot chamber of the interface valve means, the interface valve means responsive to increased pressure in the overspeed subcircuit passage means for blocking the first circuit passage means.

5. The combination of claim 4 further comprising overheat relief valve means responsive to engine coolant temperature for venting engine oil pressure from the first and second valve means whereby the first circuit passage means is blocked.

6. The combination of claim 5 further comprising second overheat relief means responsive to engine oil temperature for venting engine oil pressure from the first and second valve means.

7. The combination of claim 5 further comprising manual shutoff means for blocking the overspeed subcircuit passage means.

8. The combination of claim 2 wherein the housing defines a speed valve bore and wherein the speed sense valve means comprises:

a resiliently biased engine driven fly weight assembly;

fly weight valve spool means disposed in said speed valve bore and responsive to urging of said fly weight assembly for communicating fluid between the engine driven pump and the selector valve means at engine speeds greater than the first predetermined speed.

9. The combination of claim 8 further comprising shaft means rotatably mounted in the housing and drivingly connected with the vehicle engine for driving the engine driven pump means and the fly weight assembly.

10. The combination of claim 9 further comprising relief valve means interposed in the first circuit passage means for venting pressure above a first predetermined level in the first circuit passage means.

11. The combination of claim 19 wherein the air lock means comprises sequence valve means interposed in the second circuit passage means for blocking communication of fluid through said second circuit passage means at pressures below a second predetermined level.

12. The combination of claim 11 wherein the fuel lock means comprises orifice means in the first circuit passage means upstream of the interface valve means for reducing pressure in said first circuit passage means, and pilot operated valve means responsive to increased pressure in said first circuit passage means downstream of said orifice means for communicating fluid pressure in said first circuit passage means to the engine fuel shutoff means.

13. The combination of claim 12 wherein the pilot operated valve means includes means for venting fluid pressure in the engine fuel shutoff means to the unpressurized source of fluid while fluid pressure in the first circuit passage means downstream of the orifice means is substantially below the second predetermined level.

14. The combination of claim 1 wherein the unpressurized source of fluid comprises:

sump means defined in the housing and means for communicating lubricating fluid from the engine to the sump means.

15. An engine shutoff device for an internal combustion engine having fuel shutoff means and air shutoff means each actuable for respectively blocking fuel and air supply to the engine, the engine also having a pressurized lubrication system and a liquid coolant system; the engine shutoff device comprising:

a housing:

a source of fluid;

pump means drivingly associated with the vehicle engine for pressurizing said fluid;

conduit means for communicating engine lubricant pressure to the engine shutoff device;

first and second passage means for communicating pressurized fluid from said pump means to said source;

fuel lock means responsive to increased pressure in said first passage means for actuating the fuel shutoff means;

air lock means responsive to increased pressure in said second passage means for actuating the air shutoff means;

first sense valve means interposed in said first passage means for blocking fluid communication in said first passage means while said engine lubricant pressure is below a first predetermined level and the engine is operating below a first predetermined engine speed;

second sense valve means interposed in said first passage means for blocking fluid communication in said first passage means while said engine lubricant pressure is below a second predetermined level above said first predetermined level and said engine is operating above said first predetermined engine speed;

interface valve means interposed in said first passage means and responsive to increased pressure in said second passage means for blocking communication of fluid pressure in said first passage means;

speed sense means interposed in said second passage means and responsive to engine speed for blocking communication in said second passage means above a second predetermined engine speed.

16. The engine shutoff device of claim 15 wherein the first sense valve means comprises a pilot operated first valve means and selector valve means interposed in a series relation in the first passage means;

said first valve means responsive to engine oil pressure and said selector valve means responsive to engine speed;

said first valve means for blocking communication of fluid pressure from the pump means to the source while the engine lubricant pressure is below the first predetermined level and said selector valve means for blocking communication of said fluid pressure while said engine is operating above the first predetermined speed.

17. The engine shutoff device of claim 16 further comprising manual shutoff means interposed in the second passage means and manually operable for blocking communication in said second passage means.

18. The engine shutoff device of claim 17 wherein the second sense valve means comprises a pilot operated second valve means responsive to engine oil pressure for blocking communication of fluid pressure from the pump means to the source while the engine lubricant pressure is below the second predetermined level; and further wherein the conduit means communicates engine lubricant pressure to the pilot chambers of the first and second valve means.

19. The engine shutoff device of claim 18 further comprising overheat sense means responsive to engine coolant temperature for venting engine lubricant pressure in the conduit means upon said engine coolant temperature exceeding a predetermined level whereby the first and second valve means block fluid communication in the first passage means.

20. The engine shutoff device of claim 19 further comprising second overheat sense means responsive to engine lubricant temperature for venting engine lubricant pressure in the conduit means upon said engine lubricant temperatures exceeding a predetermined level.

21. An engine shutoff device for an internal combustion engine having fuel shutoff means and air shutoff means each operable for respectively blocking fuel and air supply to the engine, the engine further having a pressurized lubrication system; the engine shutoff device comprising:

a housing;

an unpressurized source of fluid;

fluid pump means mounted in said housing and drivingly connected with said internal combustion engine for pressurizing said fluid;

the housing defining first circuit passage means for communicating pressurized fluid from said pump means to the source;

first valve means interposed in said first circuit passage means and operably responsive to engine oil pressure for allowing communication of pressurized fluid from said pump means to said source while said engine oil pressure is greater than a first predetermined pressure;

second valve means also interposed in said first circuit passage means in a parallel arrangement with said first valve means and operably responsive to engine oil pressure for allowing communication of pressurized fluid from said pump means to said source while said engine pressure is greater than a second predetermined pressure, the second predetermined pressure being greater than said first predetermined pressure; and fuel lock means responsive to pressure in said first circuit passage means for operating the fuel shutoff means to block fuel to said engine.

22. The device of claim 21 further comprising:

speed sense valve means responsive to engine speed; pilot operated selector valve means including a pilot chamber interposed in the first circuit passage means between the first valve means and the source; and the housing further defining second circuit passage means for communicating pressurized fluid from the pump means to the speed sense valve means and from the speed sense valve means to the pilot chamber of the selector valve means;

said speed sense valve means allowing communication of fluid between said pump means and the pilot chamber of said selector valve means at engine speeds greater than a first predetermined speed, said selector valve means responsive to fluid pressure received at said pilot chamber from said speed sense valve means for blocking communication of pressurized fluid between said first valve means and said source.

23. The device of claim 22 wherein the second circuit passage means further comprises an overspeed subcircuit passage means for communicating fluid pressure from the pump means to the source and further wherein the speed sense valve means blocks said overspeed subcircuit passage means at engine speeds greater than a second predetermined speed, said second predetermined speed greater than the first predetermined speed;

the device further comprising air lock means interposed in said overspeed subcircuit passage means between said pump means and said speed sense means and responsive to increased pressure in said second circuit passage means for operating the air shutoff means to block air to the engine.

24. The device of claim 23 further comprising pilot operated interface valve means interposed in the first circuit passage means between the fuel lock means and the first and second valve means, and further wherein the housing defines interface passage means communicating the overspeed subcircuit passage means downstream of the air lock means with the pilot chamber of the interface valve means, the interface valve means responsive to increased pressure in the overspeed subcircuit passage means for blocking the first circuit passage means.

25. The device of claim 24 wherein the internal combustion engine includes a liquid coolant system, the device further comprising overheat relief valve means responsive to engine coolant temperature for venting engine oil pressure from the first and second valve means whereby the first circuit passage means is blocked.

26. The device of claim 25 further comprising second overheat relief means responsive to engine oil temperature for venting engine oil pressure from the first and second valve means.

27. The device of claim 26 further comprising manual shutoff valve means for blocking the overspeed subcircuit passage means.

* * * * *